US008074819B2

(12) United States Patent
Dexter et al.

(10) Patent No.: US 8,074,819 B2
(45) Date of Patent: Dec. 13, 2011

(54) SIPHON TUBE FOR A MULTI-CHAMBER FLUID RESERVOIR

(75) Inventors: David J. Dexter, Vicksburg, MI (US); David Hewkin, Battle Creek, MI (US)

(73) Assignee: Mann + Hummel GmbH, Ludwigsburg (DE)

( * ) Notice: Subject to any disclaimer, the term of this patent is extended or adjusted under 35 U.S.C. 154(b) by 510 days.

(21) Appl. No.: 12/248,385

(22) Filed: Oct. 9, 2008

(65) Prior Publication Data

US 2010/0089913 A1 Apr. 15, 2010

(51) Int. Cl.
*B65D 6/00* (2006.01)
*B65D 90/36* (2006.01)

(52) U.S. Cl. ..... 220/4.12; 220/4.13; 220/4.14; 220/89.1; 220/562; 220/564; 220/677; 220/678; 137/571; 137/574; 137/590

(58) Field of Classification Search ..... 220/4.12–4.14, 220/89.1, 562, 564, 677, 678; 137/571, 574, 137/590

See application file for complete search history.

(56) References Cited

U.S. PATENT DOCUMENTS 6,523,561 B2 * 2/2003 Kapcoe et al. ..... 137/15.01
6,718,916 B2 * 4/2004 Hewkin ..... 123/41.54

* cited by examiner

*Primary Examiner* — Anthony Stashick
*Assistant Examiner* — Madison L Wright
(74) *Attorney, Agent, or Firm* — James Hasselbeck

(57) ABSTRACT

A multi-chamber reservoir includes an upper and a lower body welded into unitary reservoir. A pressure relief device is interposed between a pressure chamber and the overflow chamber of the reservoir. A snap-in siphon tube is mounted into the reservoir and includes an orientation feature enforcing a desired alignment. A snap lock feature retentively mounts the siphon tube in alignment during reservoir welding.

10 Claims, 3 Drawing Sheets

SIPHON TUBE FOR A MULTI-CHAMBER FLUID RESERVOIR

TECHNICAL FIELD

The present invention generally relates to liquid coolant systems for internal combustion engines and, more specifically, to a multi-chamber coolant reservoir equipped with a siphon tube.

BACKGROUND OF THE INVENTION

Closed loop liquid coolant systems are frequently applied to remove heat that develops during the operation of internal combustion engines. A well known problem with closed loop coolant systems is that the volume of a fixed mass of coolant media will expand proportionally to the rise in coolant temperature. As the fluid capacity of the coolant recirculation system is fixed, this "excess" volume of coolant results in increasing internal pressure in the closed loop coolant system, eventually making it necessary to allow this "excess" coolant to escape to prevent overpressurization and failure of the cooling system. One quite old and well known solution is to allow this "excess" coolant to escape into the outside environment. This, of course, is highly undesirable. Also, when the engine ceases to operate and begins to cool, the opposite effect occurs. As the temperature of the coolant media drops, the volume occupied by the coolant media reduces with the temperature. This contraction in fluid volume results in a partial vacuum in the cooling system and leads to the creation of empty voids or air pockets within the cooling system. To remediate these issues, various types of coolant reservoir or surge tanks were developed and integrated with the closed loop cooling system to capture and store this "excess" coolant as the coolant temperature increases and then later return this "excess" coolant to the cooling system as the coolant temperature drops. Typically, coolant reservoirs include additional capacity above the expected "excess" to make additional coolant volume available to the coolant system to handle ongoing coolant losses over time, such as due to evaporation and minor coolant system leaks.

Various types of coolant reservoirs are known. In automotive applications coolant reservoirs are typically manufactured using an easily molded and lightweight material such as any of a variety of known plastics. Plastic also permits the reservoirs to be made transparent so that the fluid level in the reservoir can be easily discerned. It is also well known that plastic can be easily molded into a variety of useful and perhaps unusual shapes, this is often useful when fitting a reservoir into limited free space in an engine compartment. Some varieties of reservoirs are considered as "pressurized" as they are in direct fluid communication with the cooling system and experience the operating pressure seen in the closed loop coolant system. Other varieties of coolant reservoirs are considered as "overflow" tanks and are not pressurized. One typical way this is implemented is to interpose the cooling system pressure cap or pressure relief device between the reservoir and the pressurized coolant system. In such a configuration the "overflow" tank may be vented to the atmosphere without causing undesirable pressure loss to the closed loop cooling system.

During operation of the engine various gasses may become entrapped and gas bubbles may form in the coolant. The presence of entrained gas bubbles in the coolant fluid is undesirable as such gas bubbles reduce the efficiency of heat removal from the engine components, may become trapped in pockets inside the engine further reducing cooling, and is known to cause partial or total blockage of coolant flow to vehicle heater cores resulting in reduced heater performance. Therefore, degassing or deaeration of the coolant is highly desired.

In an effort to address the above problems of coolant expansion, retention and coolant deaeration, various types and configurations of coolant reservoirs have been developed.

One example is provided by U.S. Pat. No. 6,718,916 which discloses a plastic coolant reservoir having multiple chambers, a first chamber which has a direct connection to the coolant system and is therefore "pressurized", and at least a second chamber that serves as an overflow. The overflow section is isolated from the pressurized side by a spring-loaded relief device in the pressure cap. Coolant enters the overflow chamber at the top of the overflow chamber and falls into the overflow chamber.

U.S. Pat. No. 5,680,833 discloses a multi-chambered coolant receiving bottle having upper pressurized deaeration chamber and a lower overflow chamber in which the chambers are hydraulically connected to each other through a hose external to the bottle.

U.S. Pat. No. 7,000,576 discloses a container for liquids having a first fluid chamber, a second fluid chamber and a non-fluid chamber between the first and second chambers, resulting in two reservoirs in a single housing which is less expensive to manufacture and easier to install.

Unfortunately, the past methods and apparatus for multi-chamber closed liquid coolant system reservoirs have disadvantages. Some designs introduce the "excess" coolant into the overflow chamber at the top of the chamber, above the liquid level of the chamber. Such configurations result in an overflow chamber that can be filled but is difficult to draw liquid from, or in other cases that an additional hose or fluid passage be provided to draw coolant from the bottom of the overflow chamber. Additionally, it is known that introducing "excess" coolant above the overflow chamber liquid level can disturb the surface of the coolant and entrain additional air bubbles into the coolant.

As can be seen, there is a need for an improved multi-chamber coolant reservoir that overcomes the problems of the prior art.

SUMMARY OF THE INVENTION

In one aspect of the invention, a multi-chamber reservoir for fluid includes both an upper reservoir body and a lower reservoir body. The bodies are configured for welding together to define a unitary fluid reservoir apparatus having a plurality of closed fluid chambers therein, including a pressure chamber and an overflow chamber. A pressure relief device is interposed in a fluid flow path between the pressure chamber and the overflow chamber. The fluid flow path includes a first passage extending between the pressure chamber and the relief device and a second passage extending between the relief device and the overflow chamber. Also provided is a siphon tube designed for snap-in mounting into the lower reservoir body. The siphon tube includes a fluid discharge opening, generally positioned near the bottom end of the siphon tube in a region near the bottom wall of the lower reservoir body. The siphon tube has a first end, an opposing second end and an internal passage in communication with the discharge opening and together forming a portion of the second passage. The siphon tube further includes an orientation feature for enforcing a desired alignment of the siphon tube when mounting into the lower reservoir body. The fluid discharge opening is configured to deliver to and draw fluid from the overflow chamber. A snap lock feature retentively mounts the siphon tube into the lower reservoir body. The snap lock feature is adapted to hold the siphon tube in the desired alignment during the welding of the reservoir bodies. The snap lock feature enables the no-leak welding of the siphon tube to the second passage during welding of the reservoir bodies, permitting this welding to be completed in one step.

In another aspect of the present invention, the siphon tube includes an enlarged base provided at the first or lower end. The base is configured to stabilize the siphon tube in the reservoir apparatus during assembly of the reservoir apparatus.

In another aspect of the present invention, the siphon tube further includes a retainer flange extending radially outwards from the siphon tube. The retainer flange is positioned proximate to the sealing flange.

In another aspect of the present invention, the reservoir bodies and the siphon tube are formed from injection molded plastic. The siphon tube sealing flange is configured for welding to the mounting flange at the same time the body flanges of the upper and lower reservoir bodies are welded together. The snap lock feature holds the siphon tube in position during the welding process to allow simultaneous welding of the reservoir bodies and siphon tube to produce a no-leak seal between the sealing flange and the mounting flange.

In another aspect of the present invention, the welding process utilized is ultrasonic welding.

In another aspect of the present invention, the pressure relief device is provided in a fill cap which is removeably secured to the upper reservoir body.

In another aspect of the present invention, the snap lock feature includes an upper clamp member and a lower clamp member secured to an interior wall of the lower reservoir body. The clamp members each have opposing ear portions configured to elastically spread apart to engage opposing sides of an outside surface of the siphon tube. The ears provide compressive forces to retentively engage and mount the siphon tube.

In another aspect of the present invention, the orientation feature includes a projecting tab affixed to the upper clamp member and a complimentary indentation provided on the siphon tube. The complimentary indentation is sized and configured to receive a portion of the projecting tab to lock the orientation of the siphon tube.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1:
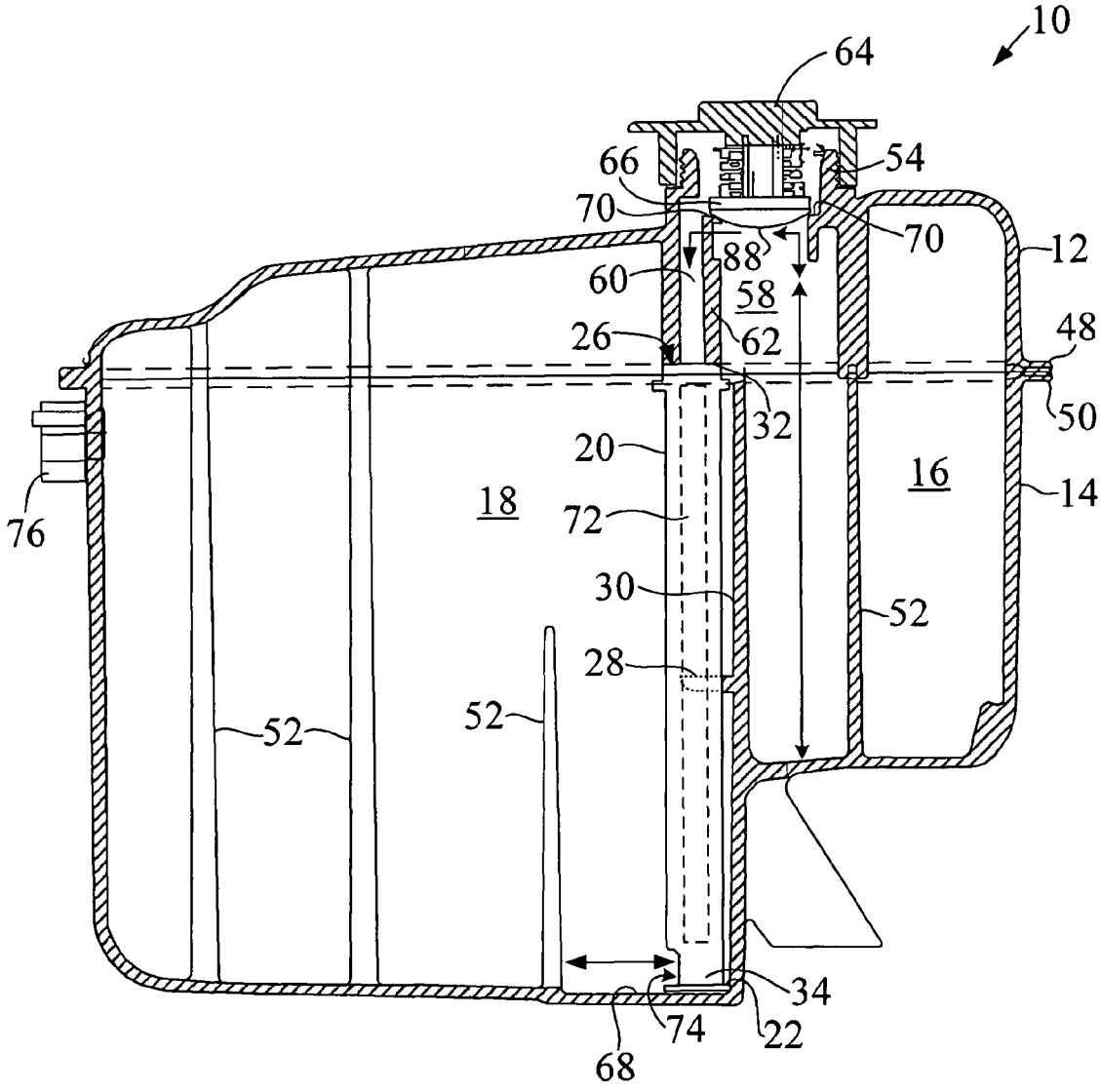
FIG. 1 is a schematic sectional side view of one embodiment of a coolant reservoir system including a siphon tube, consistent with the present invention.

The present invention generally provides a multi-chamber fluid reservoir apparatus incorporating a separate siphon tube in a portion of the fluid flow path between two reservoir chambers. FIG. 1 illustrates a schematic sectional side view of one example embodiment of a multi-chamber reservoir apparatus 10 including a siphon tube 20, consistent with the present invention. In the illustrated embodiment, the multi-chamber reservoir apparatus 10 may be a combustion engine coolant reservoir such as for a motor vehicle (not shown).

In the illustrated embodiment, the multi-chamber reservoir body apparatus 10 is formed by the sealed closure of the upper reservoir body 12 onto the lower reservoir body 14. The upper reservoir body 12 has a flange 48 that is sized and adapted to closeably mate against a complimentary flange 50 provided on the lower reservoir body 14. The flanges 48 and 50 may be securely bonded to each other by a variety of manufacturing methods, including adhesives, ultrasonic welding or hot plate welding (among others) to form the one piece or unitary multi-chamber reservoir apparatus 10.

In the particular embodiment illustrated in FIG. 1, the upper reservoir body 12 and lower reservoir body 14 may each be provided with a plurality of reinforcing ribs 52 configured to resist distortion of the walls of the multi-chamber reservoir apparatus 10, particularly in the pressure chamber 16 due to the pressure of the fluid held within.

The multi-chamber reservoir body may include a fill neck 54 secured to the upper reservoir body 12 and having a first passage 58 therethrough and in fluid communication with the pressure chamber 16. As shown, the fill neck 54 may include a second passage 60 in fluid communication with the overflow chamber 18.

A generally cylindrical siphon tube 20 is provided, having an enlarged base 22 secured at a lower or first end 34 and configured to stabilize the siphon tube 20 in the lower reservoir body 14 during assembly. In the illustrated embodiment, the base 22 is configured to supportively rest against a bottom wall 68 of the overflow chamber 18.

A threaded fill cap 64 is sized and configured to be threadably securable and sealable onto the fill neck 54. The fill cap 64 may include a pressure relief device 66. The pressure relief device 66 has a plunger portion 88 sized and configured to retractably close onto the valve seat 70, as provided in the upper reservoir body 12. The pressure relief device 66 together with the partition 62 separating the first passage 58 and the second passage 60 permit the pressure chamber 16 to be pressurized at a substantially different and higher pressure than the overflow chamber 18. The pressure relief device 66 is configured to regulate the maximum positive pressure of the pressure chamber 16, as well as to permit fluid to be drawn from the overflow chamber 18 to the pressure chamber 16 when a partial vacuum condition exists in the pressure chamber 16. Such relief devices are well known and applied in the art. When the pressure in the pressure chamber 16 exceeds a preconfigured limit, the pressure relief device unseats from valve seat 70 to permit fluid to pass from the pressure chamber 16 to the overflow chamber 18, specifically through the first passage 58, second passage 60 and siphon tube 20, thereby returning the pressure in pressure chamber 16 below the maximum configured pressure. To maintain the overflow chamber 18 at near atmospheric pressure, the overflow chamber 18 may be vented to the atmosphere, such as through vent fitting 76 preferably provided near the upper portion of the multi-chamber reservoir apparatus 10.

Figure 2A:
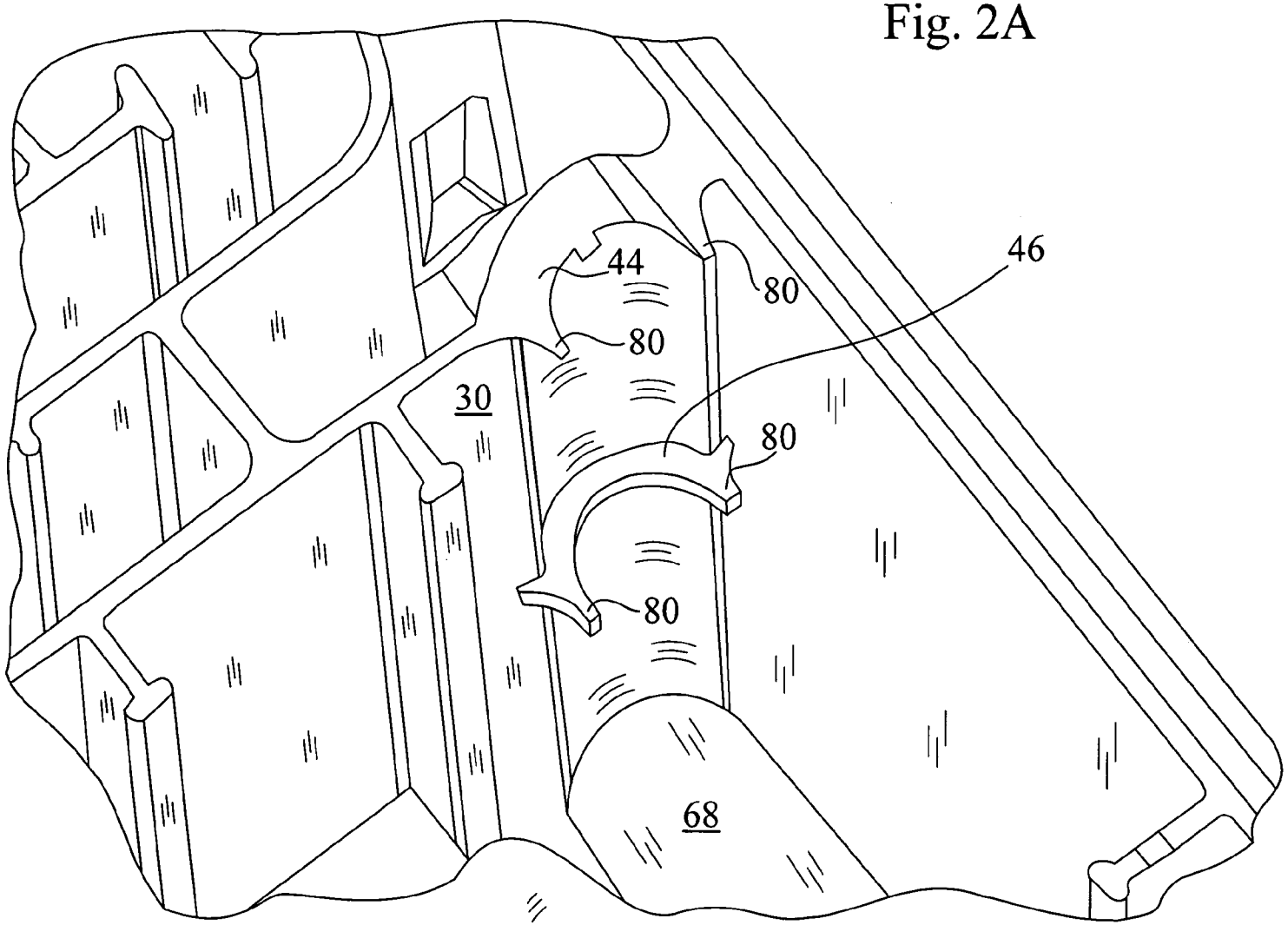
FIG. 2*a* is a perspective view of a portion of the interior of the lower reservoir body, illustrating the snap lock feature, consistent with the present invention.
Figure 2B:
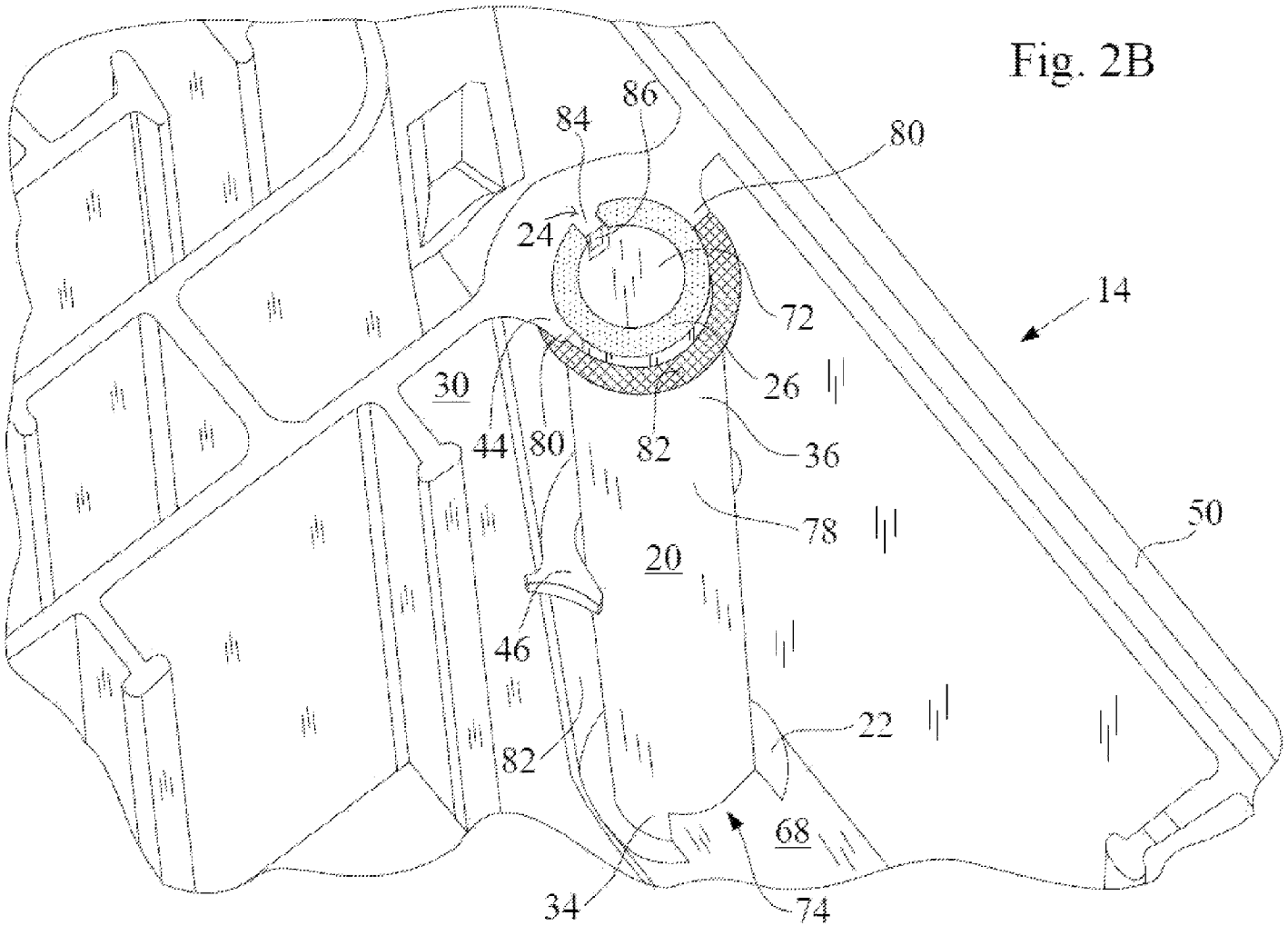
FIG. 2*b* is a perspective view of a portion of the interior of the lower reservoir body, illustrating the siphon tube retentively locked into the snap lock feature, consistent with the present invention.

Referring now to FIG. 2B together with FIG. 1, the siphon tube 20 includes a sealing flange 26 adapted and positioned to mate against and be welded to a mounting flange 32. As shown in FIG. 1, the second passage 60 extends through the mounting flange 32 to communicate with the interior passage 72 of the siphon tube. The interior passage 72 of the siphon tube 20 extends axially between the first end 34 and second end 36 of the siphon tube 20. A fluid discharge opening 74 through the wall of the siphon tube 20 is provided at the first end 34 proximate to the siphon tube base 22 and permits fluid passage between the overflow chamber 18 and the interior passage 72. The opening 74 is positioned substantially at the bottom wall 68 to enable the siphon tube 20 to substantially fully drain (by siphoning) fluid from the overflow chamber 18 up through the siphon tube 20 and into the second passage 60 as discussed previously.

Advantageously, the positioning of the opening 74 on the siphon tube 20 proximate to the bottom wall 68 of the lower reservoir body 14 assures that as fluid is delivered to the overflow chamber 18 the opening 74 is quickly submerged by the fluid, thereby maintaining the interior passage 72 fluid-filled by preventing air from entering the interior passage 72 of the siphon tube 20 through opening 74. Maintaining the fluid fill in the siphon tube 20 is advantageous to preventing a backflow of air from the overflow chamber 18 into the pressure chamber 16 when the cooling system requires make-up fluid from the overflow chamber 18 (for example, when the coolant and cooling system temperature decreases after engine operation).

Advantageously, the siphon tube 20 includes a larger diameter base 22 (larger than the siphon tube 20 diameter) extending beyond the outer wall of the siphon tube 20 providing added stability for the siphon tube 20 in resting against the bottom wall 68 during manufacturing assembly of the siphon tube 20 into the lower reservoir body 14.

Advantageously, at least one snap lock feature 28 (see FIG. 1) is provided secured onto an interior wall 30 of the overflow chamber 18 and configured to retentively engage with the siphon tube 20 so as to provide a snap-in mounting of the siphon tube 20 into the multi-chamber reservoir apparatus 10. The snap lock feature 28 retentively supports and mounts the siphon tube 20 in the required position and alignment during assembly and welding of the upper 12 and lower 14 reservoir bodies.

Advantageously, the siphon tube 20 includes an orientation feature 24 (see FIG. 2B) configured to enforce a desired alignment of the siphon tube 20 when installed into the snap lock feature 28 (for another example, upper and lower clamp members 44 and 46 as shown in FIG. 2B). In the particular embodiment illustrated in FIG. 2B, the orientation feature includes a projecting tab 84 affixed to the upper clamp member 44 and a complimentary indentation 86 on the siphon tube. The projecting tab 84 prevents installation of the siphon tube 20 into the upper clamp member 44 unless the siphon tube is oriented in the desired alignment such that the projecting tab 84 is received into the siphon tube indentation 86.

The siphon tube 20 includes a sealing flange 26 configured to mate against a complimentary mounting flange 32 provided at the fluid communication interface between the second passage 60 and the siphon tube 20. During the assembly/welding together of the upper 12 and lower 14 reservoir bodies, the sealing flange 26 is advantageously welded to the mounting flange 32 at the same time using the same welding process, for example ultrasonic welding. This welding is enabled by the snap lock feature discussed earlier which mounts and supports the tube in position during the welding step. One step welding is possible using ultrasonic welding, as well as outher welding methods such as hot plate welding. This welded connection of the siphon tube 20 to the mounting flange 32 assures the siphon tube is permanently and securely mounted in the multi-chamber reservoir 10 while also assuring a no-leak fluid seal (welded seal) between the siphon tube 20 and second passage 60.

In FIGS. 2A and 2B the snap lock feature includes upper clamp member 44 and lower clamp member 46. The clamp members 44 and 46 are positioned and distally spaced apart at the mounting location of the siphon tube 20 and configured to retentively engage against the outer surface 78 of the siphon tube 20. Advantageously, the ears 80 of the clamp members 44 and 46 are elastically spread apart during insertion of the siphon tube 20, the compressive reaction forces generated by the elastic spreading acts to retentively hold the siphon tube 20 in the desired position during assembly and welding of the multi-chamber reservoir body 10.

The siphon tube 20 also includes a retainer flange 82 (see FIG. 2B) which is positioned against or abutts the upper clamp member 44 when installed. The retainer flange 82 provides additional support to the siphon tube 20 during assembly and particularly during the welding step. The retainer flange 82 extends radially outwards from the siphon tube 20 and is positioned proximate to the sealing flange 26. Advantageously, during the injection molding process to produce the siphon tube 20, the retainer flange 82 retains the siphon tube 20 in the mold (not shown) when the mold opens, and therefore is an aid in the manufacturing process.

The siphon tube 20 has a parting line located approximately midway along the tube between the siphon tube ends 34 and 36. A disadvantage of deep draw molding is that the molding process imposes a limit in the ratio of the interior passage 72 diameter to the siphon tube 20 overall length. Advantageously, by molding the siphon tube 20 with the parting line near the middle of the length of the tube the siphon tube passage 72 can be molded in a smaller diameter than would otherwise be practical.

While the best modes for carrying out the invention have been described in detail, those familiar with the art to which this invention relates will recognize various alternative designs and embodiments for practicing the invention within the scope of the appended claims.

The invention claimed is:

1. A multi-chamber reservoir apparatus for fluids, comprising:

an upper reservoir body and a lower reservoir body, said bodies configured for welding together to define a plurality of closed fluid chambers therein including a pressure chamber and an overflow chamber;

a pressure relief device interposed in a fluid flow path between said pressure chamber and said overflow chamber, said fluid flow path having a first passage extending between said pressure chamber and said relief device and a second passage extending between said relief device and said overflow chamber;

a siphon tube designed for snap-in mounting into said lower reservoir body and having a fluid discharge opening, said siphon tube having a first end, an opposing second end and an internal passage in communication with said discharge opening and forming a portion of said second passage, said siphon tube including:

an orientation feature for enforcing desired alignment of said siphon tube into said lower reservoir body, said fluid discharge opening configured to deliver to and draw fluid from said overflow chamber, said fluid discharge opening positioned proximate to a bottom wall of said lower reservoir body to enable fully draining said overflow chamber through said siphon tube; and a snap lock feature retentively mounting said siphon tube into said lower reservoir body, said snap lock feature holding said siphon tube in said desired alignment during welding of said reservoir bodies, said snap lock feature enabling no-leak welding of said siphon tube to said second passage during welding of said reservoir bodies; and wherein said lower reservoir body includes an upper clamp member arranged on an upper portion of an interior wall of said lower reservoir body;

wherein said orientation feature includes a projecting tab arranged affixed to said upper clamp member;

a complimentary indentation on said siphon tube;

wherein said projecting tab is received into said complimentary indentation of said siphon tube.

2. A multi-chamber reservoir apparatus for storeably receiving and deaerating pressurized fluids, said apparatus comprising:

an upper reservoir body and a lower reservoir body each having complimentary flanges configured for mating to permanently and sealably secure said upper and lower bodies together defining a plurality of closed fluid chambers therein, wherein said plurality of fluid chambers include at least one pressure chamber and at least one overflow chamber;

a mounting flange provided in said upper reservoir body;

a pressure relief device interposed in a fluid flow path between said pressure chamber and said overflow chamber, said fluid flow path having a first passage extending between said pressure chamber and said relief device and a second passage extending between said relief device and said mounting flange;

a siphon tube designed for snap-in mounting into said reservoir apparatus, said siphon tube having a first end, an opposing second end and an internal passage for fluid flow between said first and second ends, said siphon tube including:

a sealing flange provided at said second end, said sealing flange adapted and positioned to mate against said mounting flange, said sealing flange provided at a fluid communication interface between said internal passage and said second passage;

an orientation feature for enforcing installed alignment of said siphon tube in said reservoir apparatus; and a snap lock feature secured to an internal wall of said at least one overflow chamber, said snap lock feature configured to retentively engage said siphon tube to provide said snap-in mounting;

wherein said pressure relief device is adapted to limit pressure in said pressure chamber by controllably venting fluid through said fluid flow path;

wherein said siphon tube is configured to deliver and draw fluid from a bottom portion of said overflow chamber;

an upper clamp member and a lower clamp member secured to an interior wall of said lower reservoir body, said clamp members having opposing ear portions configured to elastically spread apart to engage opposing sides of an outside surface of said siphon tube, said ears providing compressive forces to retentively mount said siphon tube.

3. The multi-chamber reservoir apparatus of claim 2, wherein said siphon tube includes an enlarged base provided at said first end, said base configured to stabilize said siphon tube in said reservoir apparatus during assembly.

4. The multi-chamber reservoir apparatus of claim 3, wherein said base stabilizes against a bottom wall of said lower reservoir body.

5. The multi-chamber reservoir apparatus of claim 2 wherein said siphon tube further comprises a retainer flange, said retainer flange extending radially from said siphon tube and abutting a clamp member in said lower body to further support said siphon tube during assembly, said retainer flange positioned proximate to said sealing flange.

6. The multi-chamber reservoir apparatus of claim 2 wherein said reservoir bodies and said siphon tube comprise injection molded plastic;

wherein said sealing flange is configured to weld to said mounting flange when said body flanges of said upper and lower reservoir bodies are welded together, said snap lock feature holding said siphon tube in position during welding, said welding providing a no-leak seal between said sealing flange and said mounting flange.

7. The multi-chamber reservoir apparatus of claim 6 wherein said welding comprises ultrasonic welding.

8. The multi-chamber reservoir apparatus of claim 2 wherein said pressure relief device is provided in a fill cap removably secured to said upper reservoir body.

9. The multi-chamber reservoir apparatus of claim 2 wherein said orientation feature is provided proximate to said second end of said siphon tube, said orientation feature including:

a projecting tab affixed to said upper clamp member; and a complimentary indentation on said siphon tube, said complimentary indentation sized and configured to receive a portion of said projecting tab to lock orientation of said siphon tube.

10. The multi-chamber reservoir apparatus of claim 2 wherein said pressurized fluid is coolant for an internal combustion engine.

* * * * *